United States Patent [19]

Fischer

[11] Patent Number: 4,567,930

[45] Date of Patent: Feb. 4, 1986

[54] CONSUMER-ADJUSTABLE MINI-BLIND

[75] Inventor: Jerry F. Fischer, Freeport, Ill.

[73] Assignee: Newell Companies, Inc., Freeport, Ill.

[21] Appl. No.: 496,374

[22] Filed: May 20, 1983

[51] Int. Cl.[4] ..... E06B 9/26; E06B 9/386

[52] U.S. Cl. ..... 160/166 R

[58] Field of Search ..... 160/236, 166, 178 C, 160/263, 168; 24/130; 248/548; 52/98

[56] References Cited

U.S. PATENT DOCUMENTS 192,974 7/1877 Byani ..... 24/130
921,458 5/1909 Raithel ..... 160/178 C
2,837,152 6/1958 Moore, Jr. ..... 160/168
4,139,043 2/1979 Donofrio ..... 160/236
4,157,108 6/1979 Donofrio ..... 160/263

*Primary Examiner*—Ramon S. Britts
*Assistant Examiner*—Cherney S. Lieberman
*Attorney, Agent, or Firm*—James G. Staples

[57] ABSTRACT

A mini-blind which is width adjustable by the ultimate consumer at the moment of installation without the use of hand tools is disclosed, said mini-blind including slats having lines of weakness spaced at convenient intervals which enable each slat to be shortened by snapping off the desired increments by hand applied pressure.

3 Claims, 9 Drawing Figures

Fig. 1.
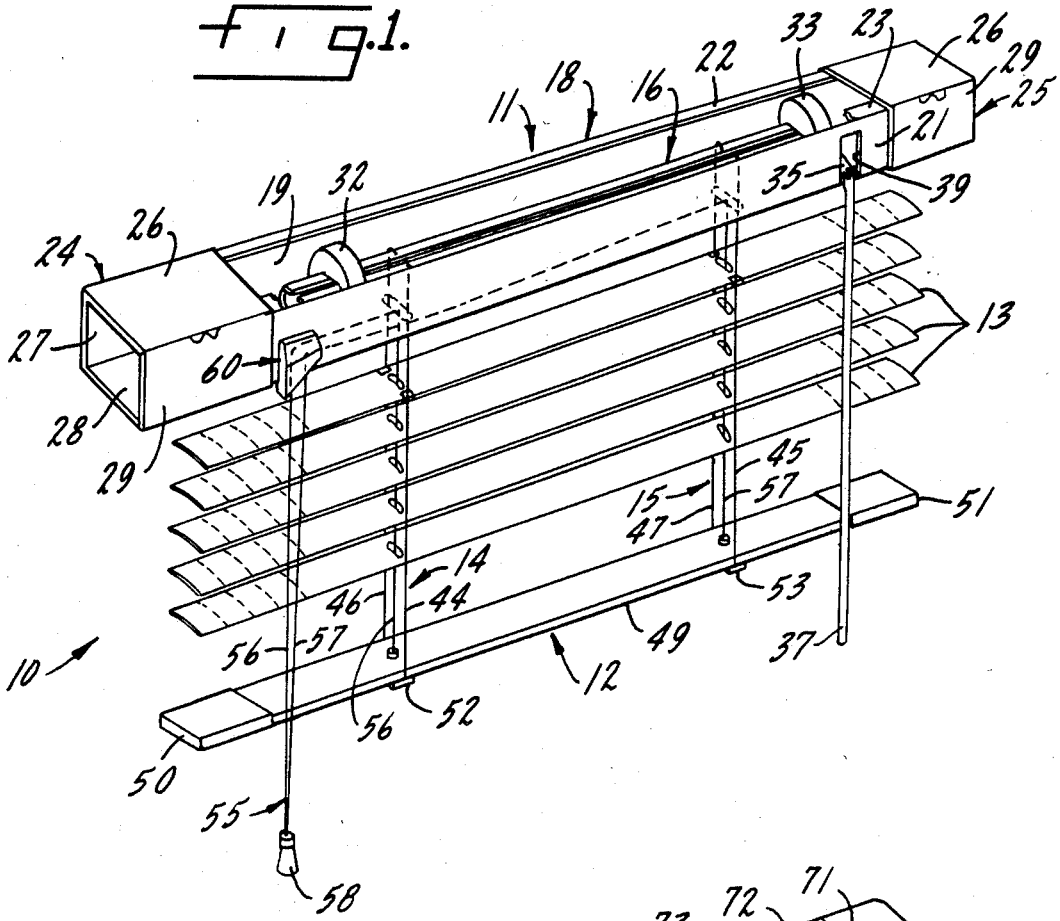
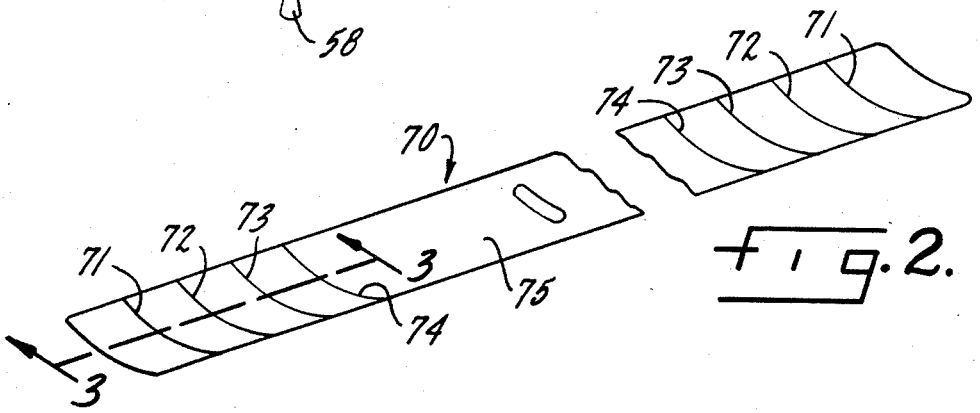
Fig. 2.
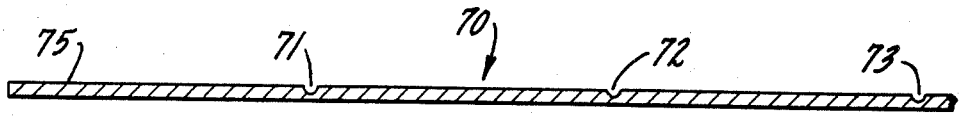
Fig. 3.

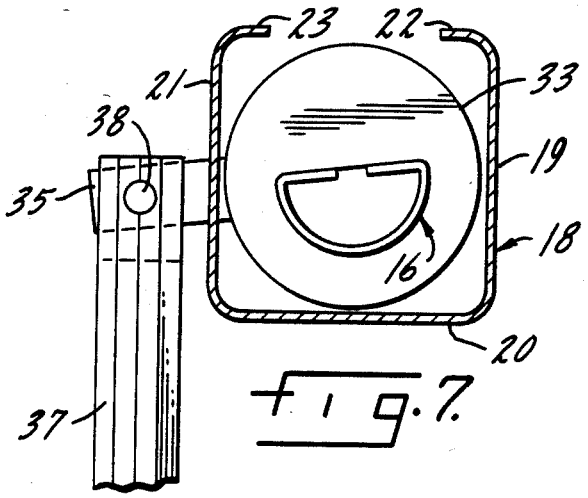
Fig. 7.
Fig. 8.
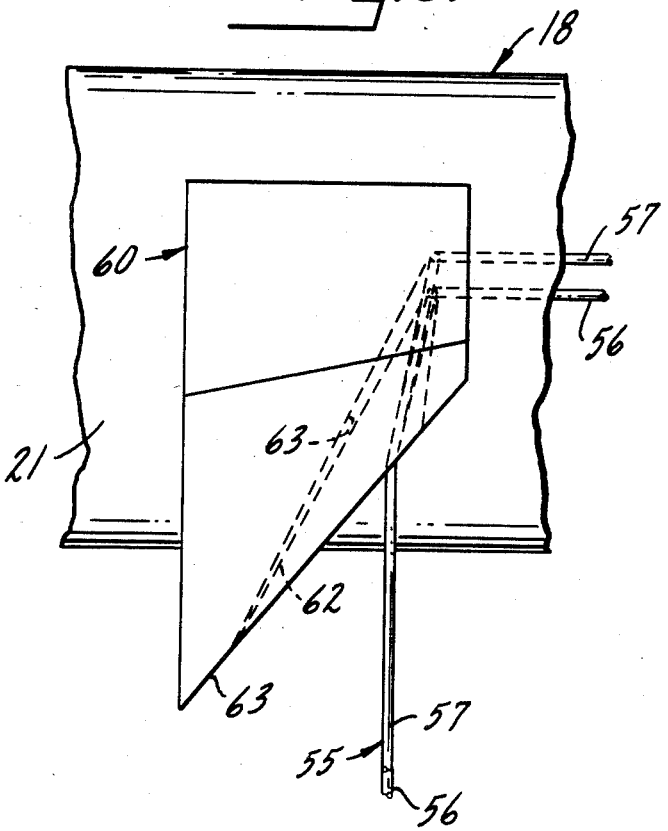
Fig. 9.
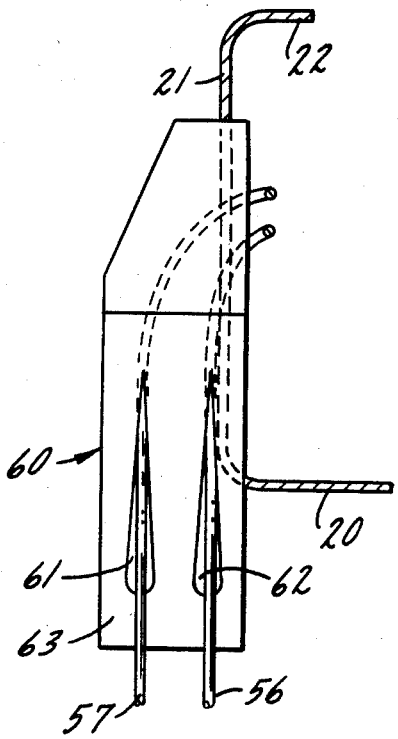

CONSUMER-ADJUSTABLE MINI-BLIND

BACKGROUND OF THE INVENTION

This invention relates generally to window coverings, and more specifically to (i) a slat window blind (hereinafter sometimes referred to merely as a "blind") which can be sized to the width needed to cover a window at the moment of installation by the ultimate user without the use of hand tools; in other words, a do-it-yourself window slat blind, and (ii) a one-piece crash-proof cord lock, which cord lock is well adapted for use in said blind. The invention is particularly adapted for use in connection with a type of blind in which a number of individual horizontally disposed slats are spaced vertically apart from one another along flexible lines, often called ladder cords, and which have a flat or slightly curved cross sectional configuration. Often such slats are approximately one inch in width and frequently the term "mini-blind" has been applied to this type of article. Although the cord lock has particular usefulness in conjunction with such a blind, the cord lock has separate application in other environments.

PRIOR ART

One type of blind which has enjoyed commercial acceptance is made of a plurality of metal slats, usually about an inch in width and often slightly curved, which are vertically suspended one above the other on ladder cords. By appropriate hand pressure applied to the ladder cords it is possible to simultaneously change the angle of tilt of the individual slats to accommodate the angle of incidence of the sun or for purposes of privacy or other reasons. Although standard lengths which are designed to fit properly in standard width windows are offered, a large percentage of such blinds must be made to measure in the sense that the window size is not of a standard width and hence the so-called standard width blinds are either too short or too long for the window in a horizontal direction. If the blind is too long it is inoperative for its intended purpose, which is to fit flush in front of the window within the window frame space. If the blind is too short it is aesthetically unpleasing to the eye and poorly functional in that light may enter the room at the edges. Accordingly, for non-standard window widths, the blind slats must be manually and specially cut to the required width, invariably by the personnel in a retail establishment where the blinds are sold, and the conventional header and bottom rail correspondingly sized.

Cutting the individual blind slats to the correct size raises problems including (a) the possibility of mismeasurement and the possibility of purchasing at considerable expense an article which does not fit properly, (b) the need to know measurements before making a purchase, and (c) the inability to find store personnel skilled in the art of making such custom type blinds.

Examples of prior art disclosures of this general type of blind are set out in the following references:

With respect to the unique cord lock disclosed herein, attention is directed to the fact that most conventional cord locks currently on the market are not self-locking, or "crash proof." That is, the typical standard cord lock device currently in use requires that the raising and lowering cords must be purposefully moved into a particular orientation in order to assure locking upon release of the cords by the user. If the cords are not moved to such a location, which is often an angled relationship to the normal, freehanging position, prior to release, premature release often permits the cords to run freely with the result that the blind, which may be in compressed, elevated position, comes crashing down.

Such crash-proof cord locks as do exist generally use a pivot arrangement, and all present crash-proof cord locks use moving parts. Such structures create the problems of additional cost, complexity of manufacture, and the possibility that the parts will grow out of adjustment with respect to each other in continued use.

SUMMARY OF INVENTION

An important object of this invention is to provide a window slat blind which can be purchased by the user without prior size measurement and without the utilization of special skills by personnel at the point of purchase, and which thereafter can be sized to a desired width at the place and moment of installation without hand tools by the ultimate user; i.e. to provide a do-it-yourself mini blind.

A further object is to provide an individual slat which is especially adapted for use in the type of blind described above.

A further important object of this invention is to provide a selflocking cord lock in which, upon a sudden release of pressure on the cords with which the cord lock is used, the cords will be automatically moved into a locked position within, at most, a very short travel.

A further object is to provide a self-locking cord lock having the just described self-locking feature in which the cord will lock irrespective of the angle which the cord makes with a normal freehanging position at the moment of pressure release.

A further object of the invention is to provide a self-locking, crash-proof cord lock that is of a one-piece construction, with no moving parts.

Yet a further object is to provide a window slat blind as above described having the above described crash proof cord lock.

Further objects and advantages of the invention will become apparent from an appreciation of the following disclosure.

BRIEF DESCRIPTION OF THE DRAWING

The invention is illustrated more or less diagrammatically in the accompanying drawing wherein:

FIG. 1 is a perspective view of the do-it-yourself mini blind of this invention in an as-purchased condition (that is, prior to width adjustment to fit into a window well which is shorter than the width of the blind in its as-purchased condition), and including the unique crash proof cord lock;

FIG. 2 is a perspective of an individual slat which is especially adapted for use in the do-it-yourself mini-blind of FIG. 1;

FIG. 3 is a section view taken substantially along the line 3—3 of FIG. 2;

FIG. 7 is an end elevation of the tilt drive rod and its actuating cover;

FIG. 8 is a front elevation of the self-locking cord lock, here disclosed in combination with the above described miniblind; and FIG. 9 is an end elevation of the cord lock.

DESCRIPTION OF A SPECIFIC EMBODIMENT

Figure 4:
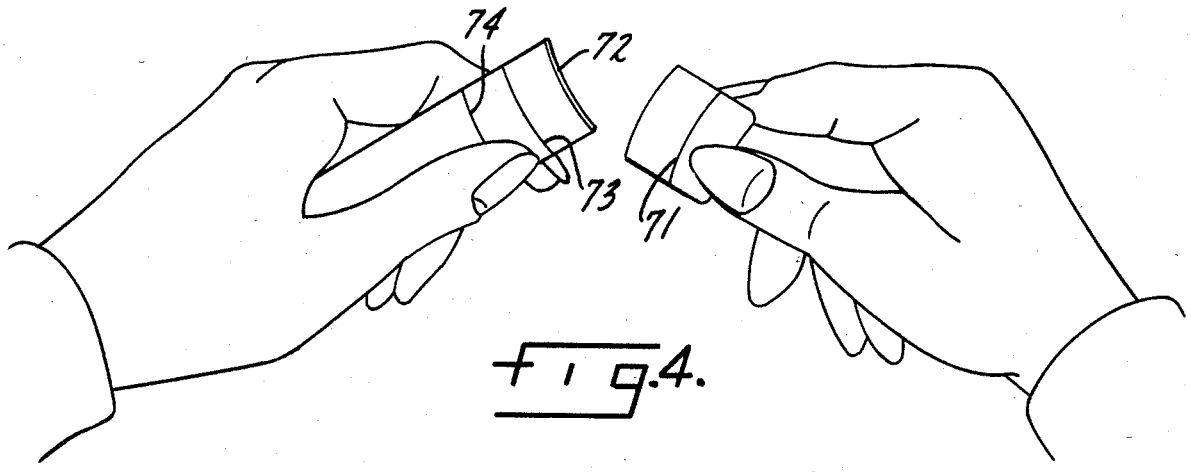
FIG. 4 is a perspective view which illustrates the mode of shortening the individual slat illustrated in FIGS. 1-3.

Like reference numbers will be used to refer to like parts from Figure to Figure in the drawing in the following description of a specific embodiment of the invention.

A complete blind assembly which illustrates the present invention is indicated generally at 10 in FIG. 1. The blind includes a header assembly, indicated generally at 11, a bottom rail assembly, indicated generally at 12, and a plurality of slats, indicated at 13. The slats and the bottom rail assembly are of course generally horizontally disposed in their intended position of use. Both the slats and the bottom rail assembly are vertically spaced, one above the other sequentially, and suspended from the header assembly by, in this instance, ladder cords 14 and 15 which are secured to the bottom rail at their lower ends, and, at their upper ends, to a combined slat support and tilt drive rod 16 which forms a part of the header assembly 11.

Figure 5:
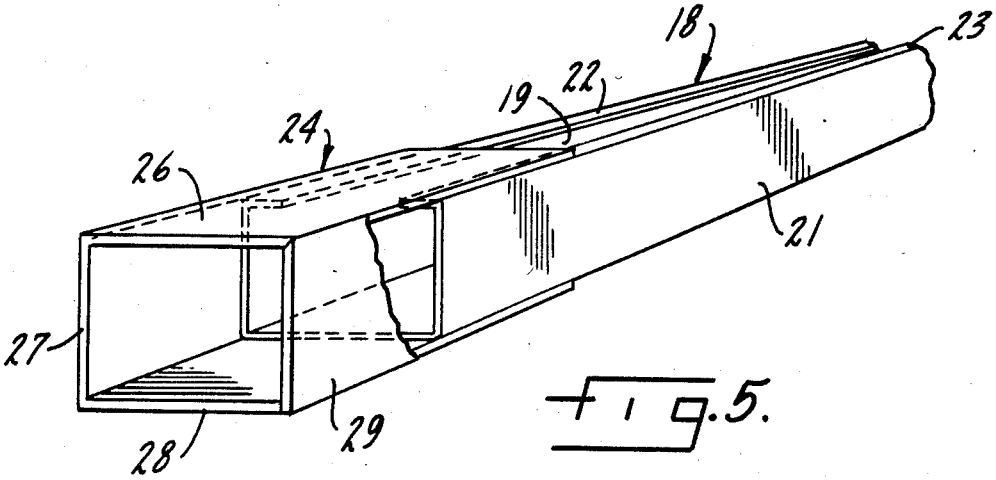
FIG. 5 is a perspective view to an enlarged scale of the header assembly housing of the do-it-yourself mini-blind of FIG. 1.
Figure 6:
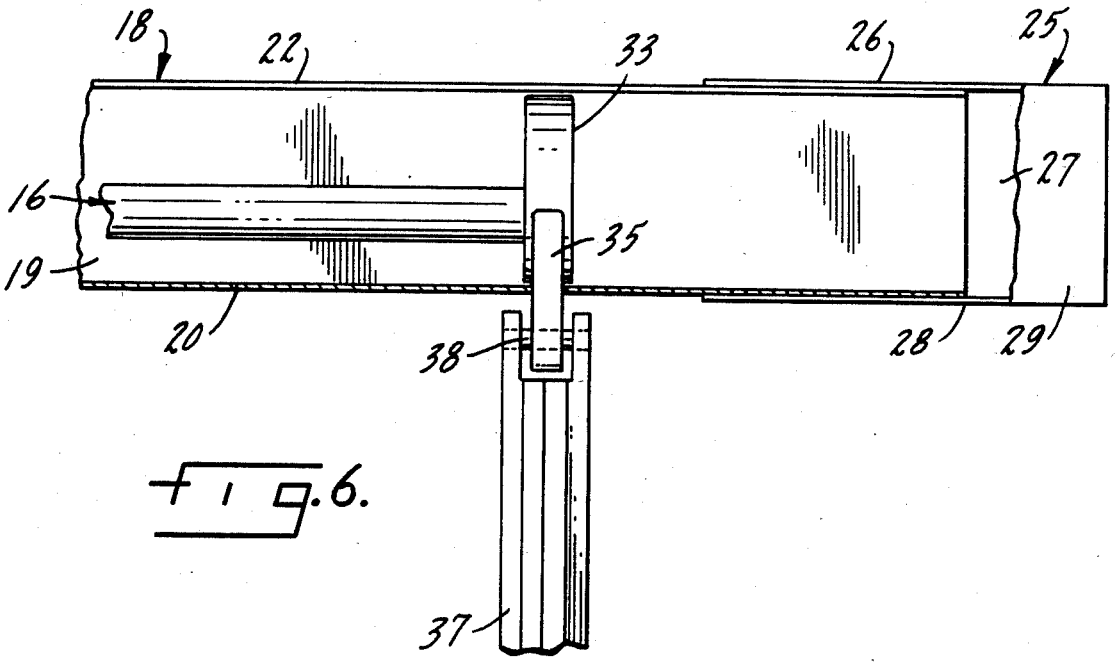
FIG. 6 is a detailed view, to an enlarged scale, of a portion of the tilt mechanism which varies the angle of inclination with respect to the horizontal of the individual slats in the blind, with parts omitted for clarity.

The header assembly 11 includes a housing 18 which, in the illustrated embodiment, is, in effect, an elongated box-like structure with a generally rectangular cross sectional configuration and an open top. The top housing 18 includes rear wall 19, bottom wall 20, and front wall 21. Rear wall 19 terminates at its upper end in an inwardly directed lip 22, and front wall 21 terminates in an inwardly directed lip 23. The open space between lips 22, 23 provides access to the interior of the header assembly. The housing 18 further includes a pair of header end brackets 24 and 25 which are constructed and arranged to snugly receive, and be slidable with respect to, the housing 18 over a definite range of movement whereby the length of the header assembly 11 can be adjusted within a given range of movement as will be further described hereinafter. Each header end bracket which, viewed from either end, is of a generally U-shaped configuration, includes a top wall 26, a rear wall 27, and bottom wall 28. The relationship of the header end brackets 24, 25 to the housing 18 of the header assembly is illustrated in greater detail in FIG. 5 from which it will be observed that each header end bracket may be slid inwardly or outwardly with respect to the housing 18 over a range of movement roughly equivalent to the length of the housing. If desired, a front wall 29 may be hinged at its junction with top wall 26 so that it can be swung to provide easy access to the end of housing 18. Alternatively, the front wall 29 may be replaced by a front plate which snaps in place.

The header assembly further includes a drive rod 16 which is anchored in rod supports 32, 33. As best seen in FIGS. 1 and 7, the rod supports are generally circular in configuration and of a size to be slid into and loosely, rotabably received in housing 18. The drive rod 16, which has a generally D-shaped cross sectional configuration, is received in matching D-shaped slots in the rod supports 32, 33. A lever arm 35 is secured at one end to rod support 33 and, at its other end, to a tilt wand 37 at 38. As illustrated best in FIGS. 1 and 7, the lever arm 35 passes through a suitably contoured slot 39 in the front wall 21 of housing 18. It will be readily understood that up and down movement of the tilt wand 37 will be transmitted to rod 16 by the lever arm 35 with the end result of rotational movement of the rod 16 about its horizontal axis.

The ladder cords 14 and 15 are connected to rod 16 by any suitable connecting mechanism, such as clips, not shown. The ladder cords are fixed to rod 16, no matter what form of connection or clip is used, so that rotation of the rod 16, as by operation of tilt wand 37, will result in an upward movement on one leg of each of the ladder cords, and a corresponding downward movement on each of the other legs. For example, in viewing the blind as presented in FIG. 1, rotation of drive rod 16 in a counter clockwise direction as viewed from the left end of the assembly will result in an upward movement of legs 44, 45 of the ladder cords 14 and 15 and a consequent and equal downward movement of legs 46, 47 of the ladder cords. Since the individual slats are supported by any suitable means from the ladder cords, such as by cross connectors, it will be apparent that the simultaneous up and down movement of the ladder cord legs will result in a tilting movement of the individual slats.

The bottom rail assembly 12 includes a bottom rail 49 and two bottom rail extensions, one at each end, 50 and 51. As illustrated, the bottom rail extensions 50 and 51 are designed to be slid inwardly or outwardly on the bottom rail 49 to shorten or lengthen the longitudinal length of the bottom rail assembly in much the same fashion as top rail brackets 24, 25 are adjustable with respect to the housing 18. The ladder cords 14 and 15 are secured to the bottom rail 49 by rail anchors 52, 53.

A lift cord is indicated generally at 55, said cord consisting of left section 56 and right section 57. A cord tassel is indicated at 58.

The unique crash proof cord lock is illustrated best in FIGS. 1, 8 and 9 wherein it will be seen that it consists of block 60 having two elongated slots 61 and 62 passing through it. The block may be connected to housing 18 in any convenient manner, such as by a snap-in connection which includes a suitably dimensioned aperture in front wall 21. The slots are wedge shaped as best seen in FIG. 9. At the bottom surface 63 of the block, where the cord sections 56 and 57 exit the header assembly, the maw of the wedge shaped opening is on the lower end of the opening which enables the cords to run freely. The cords will however bend and be gripped securely at the narrow, upper end of each slot whenever the cords move to their natural, vertical position which is the position they move to under the influence of gravity acting on the raised slats.

Unlike conventional cord locks, the cord lock herein disclosed is of one-piece construction, with no moving parts. It is thus easier to manufacture, and there are no parts to wear out with respect to each other.

The lift cord passes through a crash proof cord lock and retainer, this assembly functioning to lift upwardly or drop downwardly, in accordian fashion, the slats irrespective of what angle of tilt they may be disposed in.

An individual slat 70 is illustrated best in FIGS. 2 and 3. The slat is a thin, elongated piece of metal in which the dimensions are such that the length is considerably greater than the width, and, as can be best appreciated from FIG. 1, the width is greater than the thickness; that is, the ratio of the width to the thickness is invariably greater than one to one. As best seen in FIGS. 1 and 2, the contour of each individual slat is preferably, although not necessarily, slightly curved in a downwardly concave direction. Note that the slat in FIG. 2 has been rotated 180° from its normal position when in use for purposes of illustration.

The slat is composed of materials which have been conventionally used in the art for blind slats. Such conventional materials as aluminum have been found to work perfectly satisfactorily.

Referring now to FIG. 3, it will be noted that a series of depressions 71, 72, 73, 74 are formed in the bottom surface 75 of each end portion of the slat 70. Although four depressions have been shown, it should be appreciated that a greater or lesser number may be provided, and their spacing may be any convenient length. In practice, either half—or quarter-inch spacing have been found to be quite suitable. Each of the depressions 71–74 forms, in effect, a line of weakness which functions as a potential break line during the sizing operation The lines of weakness may be formed by any suitable means such as material removal as by shaving, or by the simple application of compression force in a punch press. Alternately, the lines may be scribed or etched into the metal. Since the material from which the slat 70 is made is generally relatively soft in nature, such as aluminium, it will be readily understood by those skilled in the art that such materials may be rather easily deformed and compressed in the thickness range which characterizes the conventional mini-blind. By way of illustration, but not limitation, a slat thickness of about 0.012 inches is conventional in the art. Thus assuming the slat 70 is composed of aluminium or aluminium base material and is approximately 0.012 inches thick, the depression may be only on the order of about 0.002–0.004 inches since this degree of depression has been found quite sufficient to insure that a clean break is achieved every time the hand applied pressures illustrated in FIG. 4 are applied to the slat to shorten it. Since the depressions may be formed in the slat in a painted condition, and the depth of depression is so slight as to not to cause cracking or chipping of paint conventionally used on this type of product, no unslightly defects appear in the final, size-adjusted article. For purposes of description and illustration, the depth of the depressions has been amplified. It will be appreciated that, in final form, the depressions may be so slight as to be virtually undiscernable to the touch.

The use and operation of the invention is as follows.

Referring now to FIG. 4, it will be noted that the ultimate user of the blind assembly is able to adjust the length of the blind assembly to the exact width required, within the limit of the spacings between the lines of weaknesses 71–74, by simply snapping off the unwanted portion of the slat by the application of hand applied pressure forces.

Specifically, a user who decides to buy a blind assembly in a retail establishment, either as a preplanned purchased or as an impulse purchase, need not know the exact window width into which the blind is to be fitted. All that is needed to be known is the approximate width of the window. Knowing that, the purchaser merely selects, on an off-the-shelf basis, a blind assembly which the purchaser knows is at least as wide as the window opening into which the blind is to be fitted. The purchaser then pays for the purchase at the cash station without any further assistance from the retail establishment personnel, and takes the blind home or to the location in which the blind is to be installed.

By holding up one of the slats to the window opening into which the blind is to be assembled the purchaser can immediately determine what the appropriate length of the individual slats should be. In the illustrated example of FIG. 4, and assuming each length increment between the lines of weaknesses 71–74 is one half inch, the purchaser has determined that the overall length of the slats should be shortened two inches, or, as illustrated, one inch at each slat end. Accordingly, the purchaser merely snaps off the two one half inch increments of slat length at each end of the slat in its as purchased condition, and the slat is thus ready for mounting in the window opening.

After the individual slats 70 have been sized to the correct width, the user then slides bottom rail extensions 50 and 51 inwardly on bottom rail 49 until the width of the bottom rail assembly 12 equals the width of the size-adjusted slats 13. Thereafter the header end brackets 24 and 25 are similarly slid inwardly on housing 18 to a width which corresponds to the approximate width of the slats 13.

The entire assembly is then mounted into the window opening by any suitable means, which means do not form an integral part of the present invention.

Once located in the window opening the slat will present the same aesthically eye pleasing appearance as do conventional slats which are custom sized to length by the retail establishment. This results from the fact that the depressions 71–74 are on the underside of the slat, and are not discernable by the human eye at the normal viewing distance of the blind assembly.

In use, the angle of tilt of the slats 13 is controlled as desired by tilt wand 37. An upward push on the wand results in clockwise rotation of drive rod 16 (as viewed in FIG. 7) by means of connector 38 and level arm 35, and hence movement of the individual slats into, ultimately, a light blocking position. A downward pull on the wand 37 results in counter-clockwise rotation of drive rod 16 (as viewed in FIG. 7).

The blind is raised or lowered by operation of lift cord 55. A downward pull on lift cord 55 raises the individual slats from the bottom, with each lower slat moving upwardly after the slat, or slats, beneath it are brought in contact with its underside. During the lifting operation the sections 56 and 57 of the lift cord 55 are released from their held position at the converging end of wedge 61, 62 (see FIG. 9).

One of the unique features of the one-piece cord lock of this invention is that the user, after having raised the blinds to the desired height, need not remember to consciously move the lift cord 55 to a position in which the section 56 and 57 are physically moved into engagement with the sharp apex end of the slots 61, 62. Rather, the user can merely release the cord 55 after the blind has been raised to the desired height and the cord sections 57, 56 will automatically self-lock in the sharp apex edge of wedges 61, 62 respectively. A very slight downward movement, usually a small fraction of a centimeter, may occur prior to the self-locking action taking effect due to the brief moment of time it takes the cord sections 57, 56 to move from a position in which they are not in wedge contact with the sharp apex of their respective slot to their locked position in which the wedge action between the sides of the slot and a cord preclude further movement. Since the sharp apex of the slots are disposed in opposition to the position toward which the cord sections will move under the influence of gravity if the individual slats move downwardly in a free fall, the "grabbing" or locking action will be almost immediate, and thus the blind is made crash proof.

Although a specific embodiment of the invention has been illustrated and described, it will be apparent at once to those skilled in the art that different structural arrangements may be arranged without departing from the spirit and scope of the invention.

For example, the unique, one-piece, crash proof cord lock illustrated and described herein is disclosed in combination with the unique, size-at-home blind, but it will be appreciated that the cord lock may be utilized in other environments which require automatic locking of vertically hanging cords or lines, such as, for example only, marine or construction applications.

Accordingly, it is intended that the scope of the invention be limited not by the specific, illustrated construction, but rather solely by the scope of the hereinafter appended claims when interpreted in light of the pertinent prior art.

We claim:

1. A do-it-yourself blind assembly which is width adjustable by the user at the place and moment of installation without the use of hand tools, said blind assembly including a plurality of slats, each slat having a width to thickness ratio of greater than 1 to 1, means for suspending the slats in vertically spaced relationship one to the other, means for suspending the blind assembly from support locations which permit the slats to hand vertically one above the other in spaced relation one to the other, at least one end portion of each slat having at least one line of weakness adjacent the end edge of said slat, said line of weakness being disposed transversely to the longest dimension of the body of the slat and being formed by a depression which is formed in one face of the slat and which extends from side edge to side edge of the slat, the thickness of the body of the slat beneath the line of weakness being less than the thickness of the body of the slat on either side of the line of weakness, the face of the slat, which is opposite the slat face in which the depression is formed, being smooth and substantially uninterrupted in the area opposite the depression, whereby the length of the slat may be shortened by pressure forces which are hand applied adjacent the line of weakness to remove that portion of the slat lying between the line of weakness and the end edge of the slat.

2. The do-it-yourself width-adjustable blind assembly of claim 1 further characterized in that firstly, the slats are formed from metal, and secondly, the metal underlying the depression is compressed as contrasted to the metal immediately adjacent the depression on either side thereof.

3. The do-it-yourself width-adjustable blind assembly of claim 2 further characterized in that firstly, the slats are formed from metal, and secondly, the line of weakness is formed by etching or scribing.

* * * * *